US007657209B2

(12) United States Patent
Sabo et al.

(10) Patent No.: US 7,657,209 B2
(45) Date of Patent: Feb. 2, 2010

(54) APPARATUS FOR CONTAINING SPLASHES IN AN INK DEVELOPER

(75) Inventors: David Sabo, San Diego, CA (US); Marco A. Guzman, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 190 days.

(21) Appl. No.: 11/903,937

(22) Filed: Sep. 24, 2007

(65) Prior Publication Data

US 2009/0080939 A1 Mar. 26, 2009

(51) Int. Cl.
*G03G 15/10* (2006.01)

(52) U.S. Cl. ..... 399/237; 399/249

(58) Field of Classification Search ..... 399/237, 399/249, 239

See application file for complete search history.

(56) References Cited

U.S. PATENT DOCUMENTS

| | | | |
|---|---|---|---|
| 5,452,042 | A | 9/1995 | Pummell |
| 6,941,090 | B2 | 9/2005 | Uchida |
| 2006/0153597 | A1 | 7/2006 | Guzman et al. |
| 2007/0177906 | A1 | 8/2007 | Yamanaka et al. |

FOREIGN PATENT DOCUMENTS

| | | | |
|---|---|---|---|
| JP | 62211675 | A | 9/1987 |
| JP | 05346728 | A | 12/1993 |
| JP | 07-333969 | | 12/1995 |
| JP | 2005070383 | A | 3/2005 |
| JP | 2005257739 | A | 9/2005 |
| WO | WO 2006/076107 | A1 | 7/2006 |
| WO | WO 2007/018503 | A1 | 2/2007 |

*Primary Examiner*—David M Gray
*Assistant Examiner*—Gregory H Curran

(57) ABSTRACT

A splash guard is configured to control the flow of excess liquid generated by an interaction between a first roller and a second roller by splitting the flow of the excess liquid into a first flow and a second flow.

15 Claims, 7 Drawing Sheets

APPARATUS FOR CONTAINING SPLASHES IN AN INK DEVELOPER

BACKGROUND

In printing devices that utilize liquid ink, the flow of ink can result in splashing. As the ink splashes, it can adhere to some parts of the printing device. Over time, the carrier liquid is evaporated and the accumulated layers of concentrated ink (or sludge) can block or limit the further flow of the ink. This, in turn, can result in malfunctions and breakdowns.

Cleaning the parts that contain the accumulated ink can be time-consuming and costly. In particular, removing the accumulated ink can be difficult without disassembling the device, which sometimes makes this option unworkable in the field.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Figure 1:
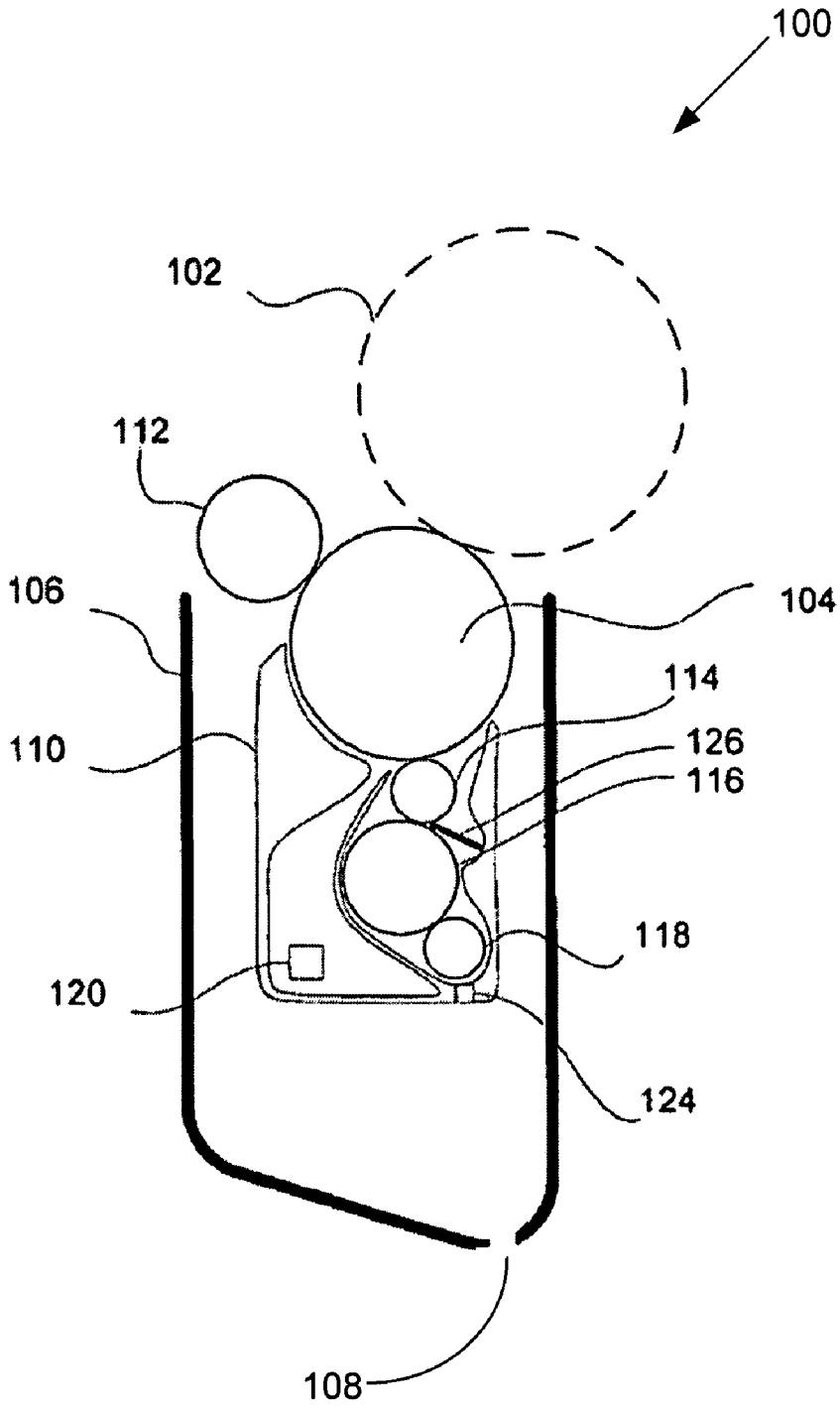
FIG. 1 shows one illustrative embodiment of an ink developer device, according to principles described herein.

FIG. 1 shows a side view of one exemplary embodiment of an ink developer device (100), in accordance with one implementation. The ink developer device (100) may be a binary ink developer (BID) unit. Furthermore, the device (100) may be utilized in liquid electro photography (LEP) printers.

One of the primary purposes of the ink developer device (100) is to provide a uniform film of ink to a photo-conductive drum (102). To do this, the device (100) utilizes a continuous flow of ink that enters the developer (100) through an inlet port (120) and circulates through the device to where a small portion of the ink is transferred to the photo-conductive drum (102) as will be explained in detail below. A majority of the ink flow then exits the device (100) through an ink outlet (108). This excess ink returns to an ink reservoir where it is reconditioned and recirculated into the device (100) through the inlet port (120).

The ink consists of a fluid carrier and ink particles. The ink particles are suspended in the fluid carrier, which allows the ink particles to be easily transported, stored, and manipulated. The ink particles are influenced by the presence of electromagnetic fields, while the fluid carrier is not.

The developer device (100) includes an ink developer roller (104) that is configured to supply a uniform film of ink which can be selectively transferred to the photoconductive drum (102). The developer roller (104) rotates through the flow of ink within the developer device (100) to convey an inked surface to the photoconductive drum (102).

To selectively transfer the ink to the photoconductive drum (102), a charge pattern that corresponds to the image being printed is generated on the photoconductive drum (102) by a laser (not shown). Ink on the outer surface of the developer roller (104) is attracted by and transferred to the charged portions of the photoconductive drum (102). This creates a liquid ink pattern in the form of the image to be printed. This developed image is then transferred from the photoconductive drum (102) to a print medium such as paper or to an intermediate transfer member (not shown) and then onto a print medium to form the desired image on the print medium.

The developer device (100) also includes an ink tray (106) to contain the ink flow and direct any excess ink to the ink outlet (108). A main electrode (110) and the developer roller (104) are electrically charged to manipulate the ink particles. Additionally, the gap between the main electrode (110) and the developer roller (104) creates a channel through which the ink is conveyed by the viscous action of the rotating drum (104). The main electrode also supports the various parts of the device (100).

A squeegee roller (112) contacts the developer roller (104) at an interface between the two rollers. At this interface, the squeegee roller compacts the ink film on the developer roller (104) and removes any excess ink to create a uniform film of ink on the surface of the developer roller (104). The outer surface of the developer roller is initially coated with a layer of ink as it comes in contact with ink that is pumped into the device through ink inlet (120). Due to the electrostatic field generated by the electrical potential between the main electrode (110) and the developer roller (104), the ink particles preferentially adhere to the developer roller (104), creating a high solid content ink film on the surface of the developer roller (104). The squeegee roller (112) compacts this high solid content ink film and knocks down the excess lower solid content ink. As the squeegee roller (112) knocks down this ink, it can cause drops to form that can splash out of the binary ink developer and cause leaks.

As noted above, such leaks and accumulated ink deposits that result can cause an ink developer device to fail in at least three ways: cross-contamination, print quality issues, and total customer experience. Cross-contamination occurs when splashing from one binary ink developer impacts an adjacent binary ink developer and contaminates ink supplies. Print quality issues occur when splashes reach the photo imaging plate and appear as print quality defects on the page. Additionally, squeegee splashes can build up deposits of sludge inside or outside of the device. Sludge deposits can limit the actual or perceived lifetime of the device. External splashes build up on the outside of the binary ink developer as an unsightly accumulation of sludge. This can impact the total customer experience.

Other components of device (100) include: a cleaning roller (114) that cleans the developer roller (104); a wiper blade (126) to scrape excess ink from the cleaning roller (114); a sponge roller (116) to clean excess ink from the wiper blade (126) and/or cleaning roller (114); and a squeezer roller (118) to wring excess ink out of the sponge roller (116). The sponge roller (116) may come in contact with the wiper blade (126) and/or the cleaning roller (114) to clean one or both of them.

As noted, the ink inlet (120) introduces fresh or recycled ink to the binary ink developer (100). Additionally, the binary ink developer contains an ink drain passage (124) to allow the drainage of excess ink from the binary ink developer to the outlet (108) in the tray (106).

Figure 2:
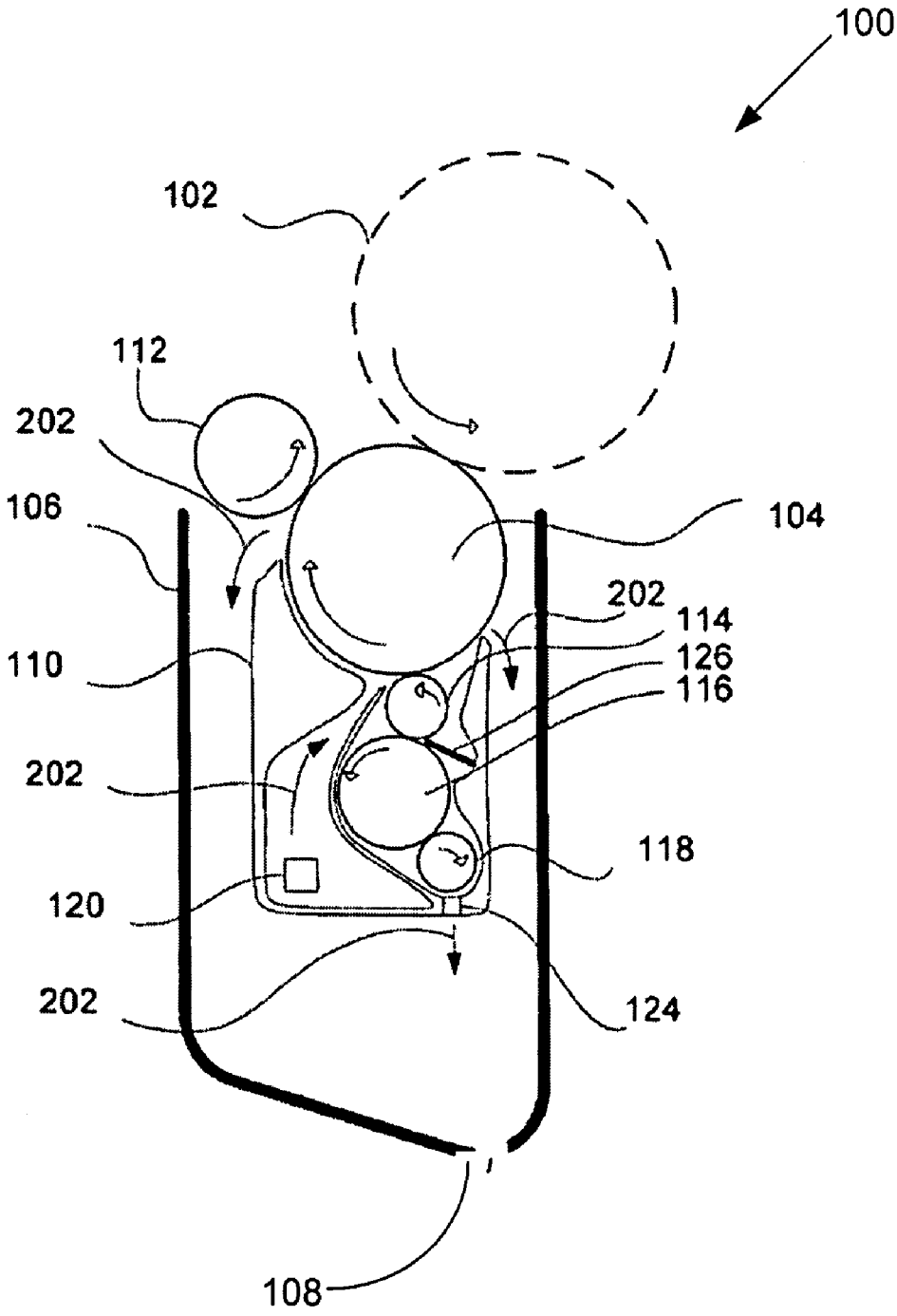
FIG. 2 shows the flow of ink in an illustrative embodiment of an ink developer device, according to principles described herein.

FIG. 2 illustrates an exemplary flow of ink in an ink developer device (100) according to one embodiment. As previously mentioned, the device (100) includes the ink developer roller (104), ink tray (106), ink outlet (108), main electrode (110), squeegee roller (112), cleaning roller (114), sponge roller (116), squeezer roller (118), ink inlet (120), ink drain passage (124), and wiper (126). The arrows inside each roller shown in FIG. 2 indicate the rotational direction of the respective roller in the illustrated example. Specifically, several rollers (102, 112, 114, and 116) are shown to rotate in a counter-clockwise direction, whereas other rollers (104, 118) are shown to rotate in a clockwise direction.

As illustrated in FIG. 2 by the ink flow arrows (202), the device (100) receives fresh (or recycled) ink from an ink supply through the ink inlet (120). This ink travels upward and enters the channel between the main electrode (110) and the developer roller (104). The electrical potential bias between the main electrode (110) and the developer roller (104) causes ink particles to preferentially adhere to surface of the developer roller (104). The squeegee roller (112) regulates the ink film thickness on the developer roller (104) prior to contact with the print drum (102). Ink is then selectively transferred from the developer roller (104) to the charged portions of the drum surface (102) as described above.

In one implementation, to provide better printing performance and to optimize the ink circulation through the device with a minimum build up of sludge, the device (100) utilizes a variety of cleaning parts, such as rollers and blades (e.g., 114, 116, and 118) described above. The cleaning roller (114) removes leftover ink from the developer roller (104). The wiper blade (126) cleans the cleaning roller (114). The sponge roller (116) removes ink from the wiper blade (126) and/or cleaner roller (114). The squeezer roller (118) wrings the accumulated ink from the sponge roller (116).

As illustrated in FIG. 2, ink that is not transferred to the photo conductive drum returns via the ink outlet (108) to the ink reservoir or container (not shown) to be reconditioned and recirculated. There are three primary channels through which the ink can travel to reach the ink outlet (108). First, the excess ink that is wrung out of the sponge roller (116) by the squeezer roller (118) can exit through the ink drain passage (124). Excess ink may also travel down the channels between the internal mechanisms and the front or rear walls of the ink tray (106). In particular, ink that is knocked down by the squeegee roller (112) passes between the main electrode (110) and the rear wall of the ink tray (106).

Figure 3:
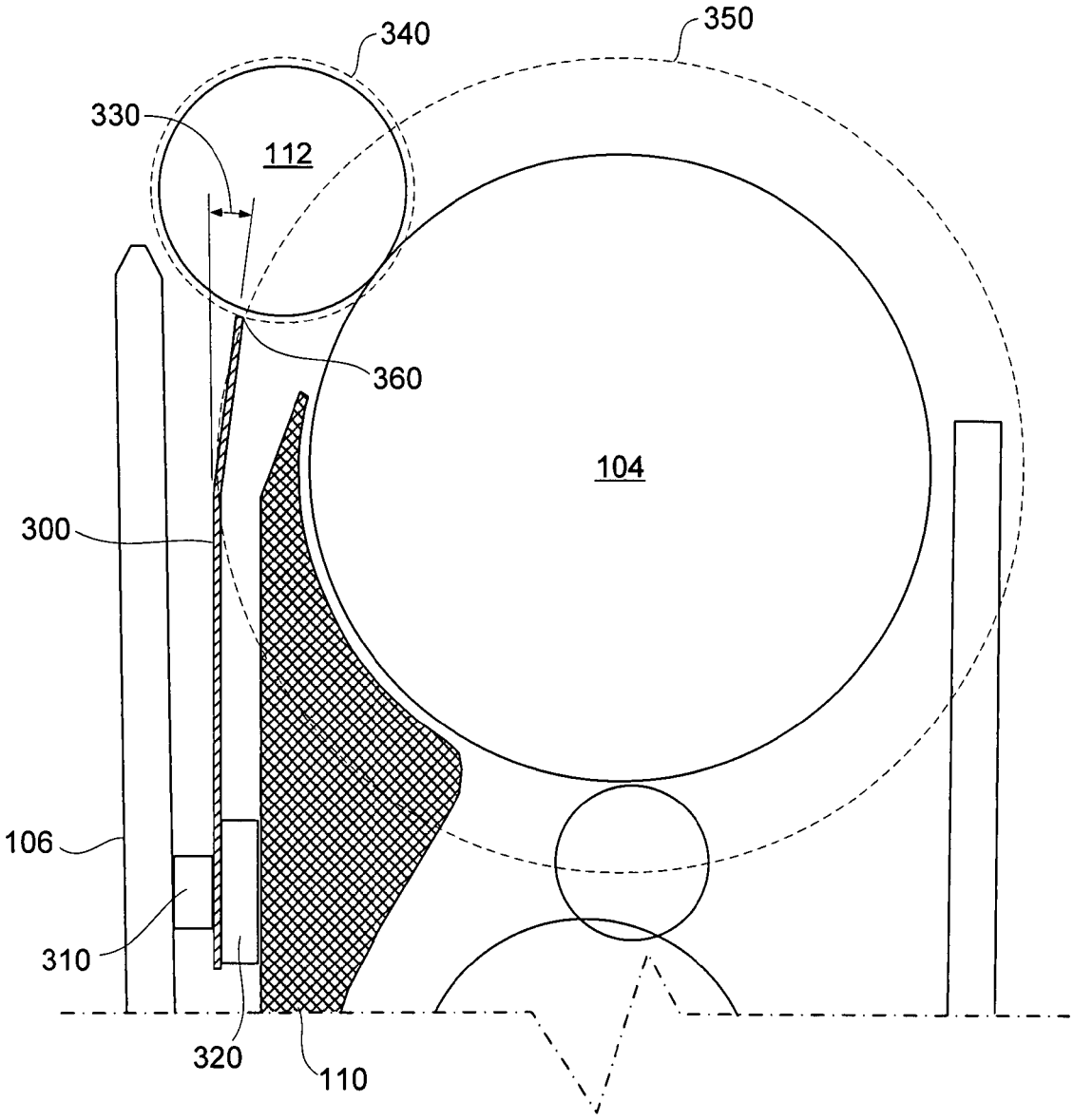
FIG. 3 shows one illustrative embodiment of a splash guard, according to principles described herein.

FIG. 3 illustrates one exemplary embodiment of a splash guard (300) used in a method to control splashes produced by the squeegee roller (112) as it compacts the ink film on the outer surface of the developer roller (104). The splash guard (300) can be attached to the main electrode (110) and/or the ink tray (106). A first spacer (310) maintains a desired distance between the splash guard (300) and the ink tray (106). A second spacer (320) maintains a desired distance between the main electrode (110) and the splash guard (300). The spacers also create or allow channels for the ink that is knocked down by the squeegee roller (112) to return to the bottom of the ink tray (106) and exit through the ink outlet (108). If the channels created by the spacers (310, 320) are excessively wide, the evaporation of the fluid carrier could be unnecessarily increased. The evaporation of the fluid carrier leads to the accumulation and adhesion of ink particles on the surfaces of the device (100). Excessively narrow channels could restrict the flow of ink and cause the ink to overflow out of the developer device.

The location of the splash guard tip (360) can be important in maximizing the effectiveness of the splash guard (300) in containing squeegee roller splashes. FIG. 3 illustrates three dimensions that describe the location of the splash guard tip (360) relative to the other components of the device (100). A first dimension (330) describes the angle at which the splash guard (300) approaches the squeegee roller (112) and the developer roller (104). A second dimension (340) is shown as a dashed circle concentric with the squeegee roller (112). The second dimension (340) is a measure of the closest approach of the splash guard tip (360) to the outer surface of the squeegee roller (112). A third dimension (350) is shown as a dashed circle concentric with the developer roller (104). The third dimension (350) is a measure of the closest approach of the splash guard tip (360) to the outer surface of the developer roller (104).

A prior design approach involved increasing the height of the binary ink developer tray (106) to prevent splashes from exiting the binary ink developer. However, because of the proximity of the squeegee roller (112) to other parts of the printing press, the height of the tray wall near the squeegee roller (112) is severely limited. Testing showed that even when the tray wall was raised to its maximum height, it could not completely eliminate squeegee splashes.

Another approach was to design a splash guard (300) that came very close to the outer surface of the squeegee roller (112). By minimizing the second dimension (340), it was hoped that the ink flow over the back of the splash guard would be completely eliminated. Testing showed that, with as little as a 0.1 mm gap between the splash guard tip (360) and squeegee roller (112), there was still a minimal amount of ink flowed over the back of the splash guard (300). Although this design approach initially reduced the splashes outside the binary ink developer tray (106), it had other undesirable results. During operation, the small amount of ink that flow over the back of the splash guard would solidify and eventually cause the ink to overflow out of the binary ink developer tray (106).

Figure 4:
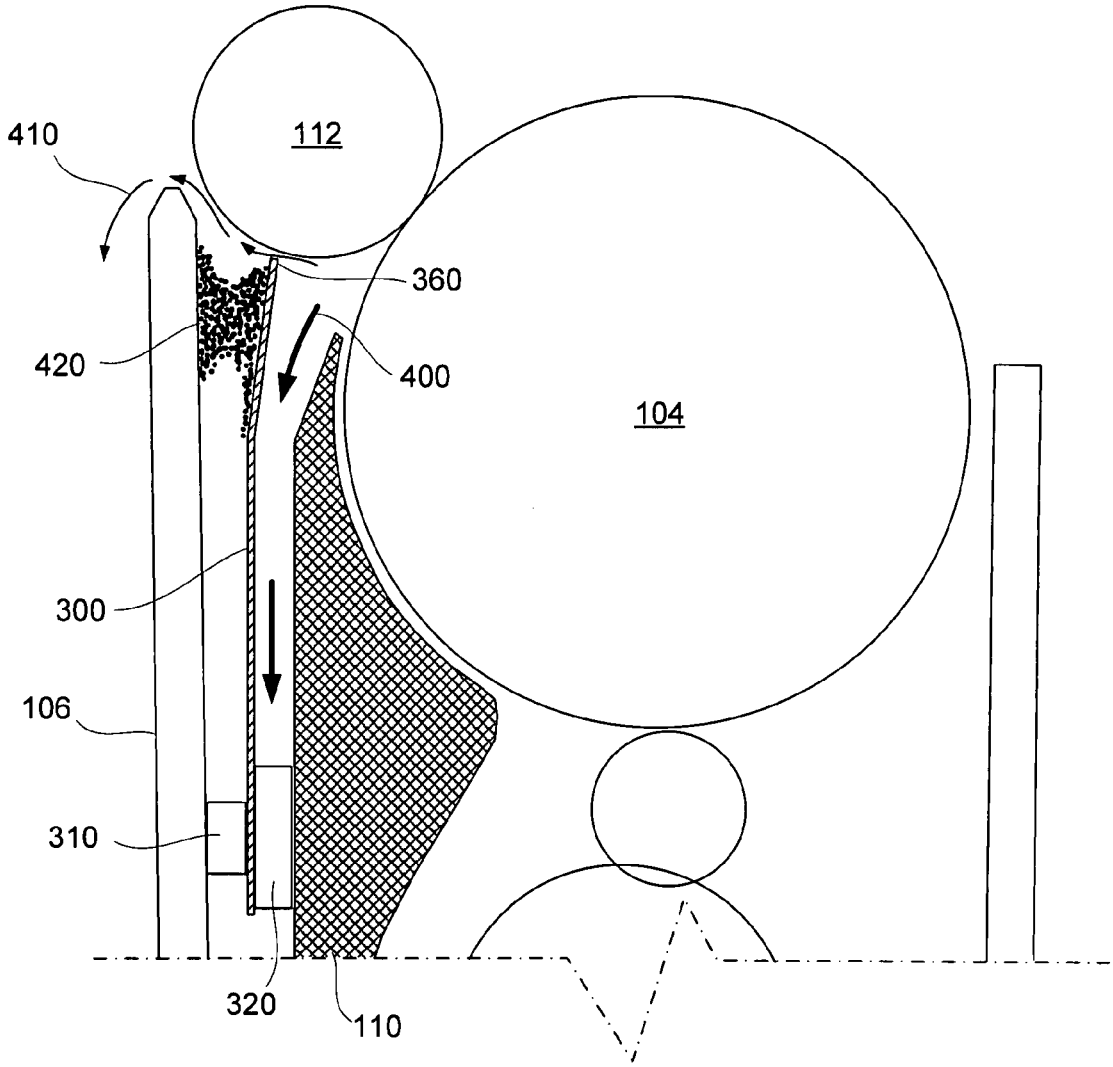
FIG. 4 shows the accumulation of sludge and the resulting flow of ink in an ink developer device, according to principles described herein.

FIG. 4 illustrates the result of small amounts of ink flowing over the back of the splash guard (300) and solidifying as sludge. In FIG. 4 arrows (400) illustrate that the majority of the ink knocked down by the squeegee roller (112) passes between the main electrode (110) and the front face of the splash guard (300). A small portion of ink (410), however, flows in between the splash guard tip (360) and the squeegee roller (112).

As that small portion of ink (410) slowly trickles down the back of the splash guard (300), a large percentage of the fluid carrier evaporates. As the carrier fluid evaporates, the ink particles adhere to one another and to the surrounding surfaces. This accumulation of dried ink is called sludge. Over time, sludge (420) accumulates on the backside of the splash guard (300) and the inside of the ink developer tray (106).

As shown in FIG. 4, this sludge (420) continues to accumulate until it completely blocks the passage created by the first spacer (310). Consequently, the ink that passes between the splash guard tip (360) and the squeegee roller (112) no longer has a return path to the bottom of the ink tray (106). Instead, the ink (410) fills the remaining open volume in between the splash guard (300) and the ink tray (106) and escapes over the top of the ink tray (106). As mentioned above, this escaping ink (410) can cause binary ink developer failure by cross-contamination, low print quality, and/or by the accumulation of unsightly sludge on the outside of the binary ink developer.

Figure 5:
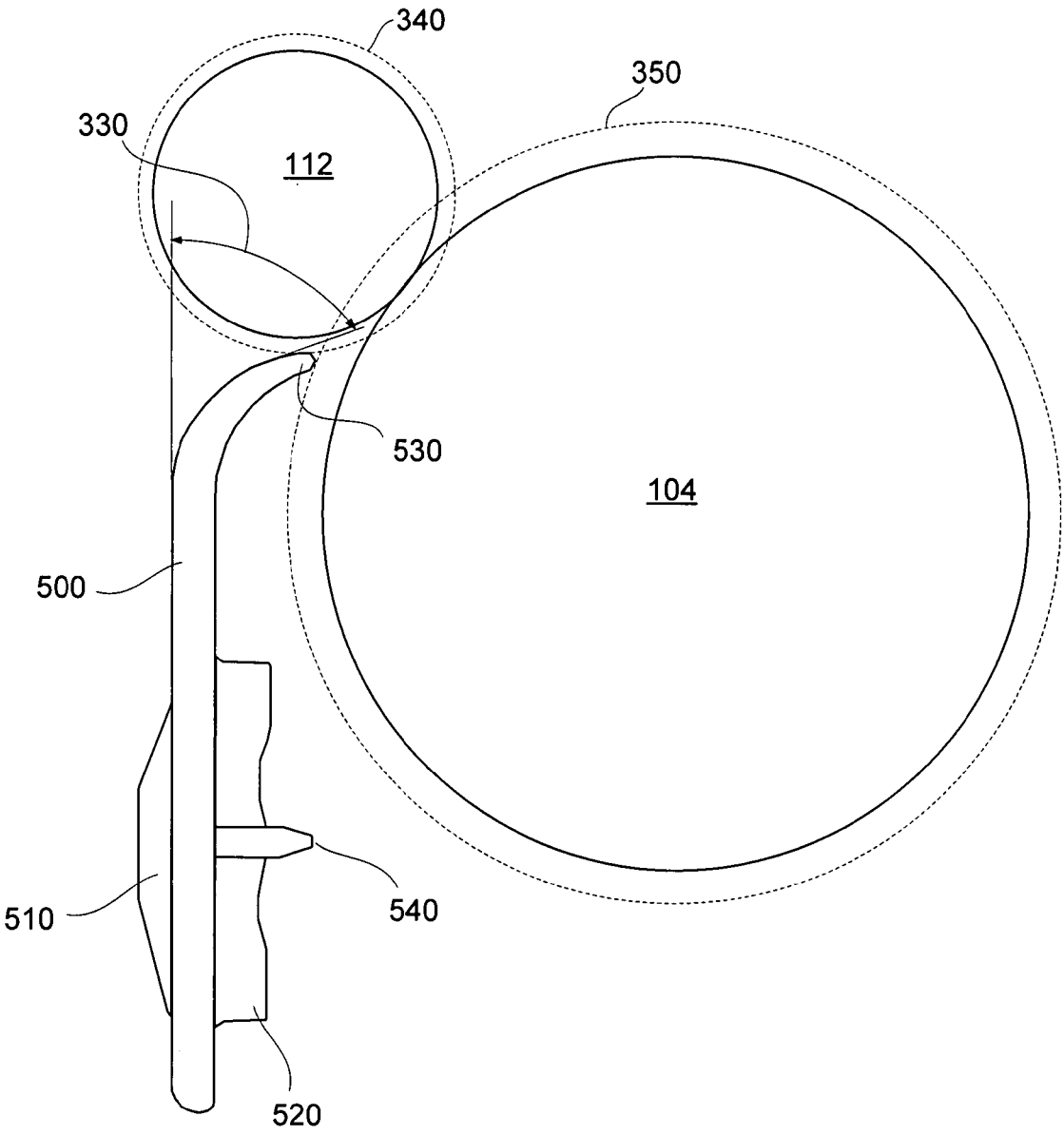
FIG. 5 is a cross-sectional diagram of an illustrative ink developer device, according to principles described herein.

FIG. 5 shows an improved splash guard (500). As previously mentioned, a splash guard (500) is a component that can be placed between the main electrode (110) and the tray (106) of the binary ink developer to control the flow of excess ink knocked down by the squeegee roller (112). The width of the channel between the ink tray (106) and the splash guard (500) is defined by a first spacer (510). The spacing between the main electrode (110) and the splash guard (500) is maintained by a second spacer (520). A vertical alignment feature (540) can be received within a matching cavity in the main electrode (110, FIG. 3) to precisely position the guard (500) with respect to the other components.

The splash guard tip (530) approaches the squeegee roller (112) and the ink developer roller (104) at relatively high angle as shown by a first dimension (330). A second dimension (340) is shown as a dashed circle concentric with the squeegee roller (112). As discussed above, the second dimension (340) is a measure of the closest approach of splash guard tip (530) to the outer surface of the squeegee roller (112). A third dimension (350) is shown as a dashed circle concentric with the developer roller (104). The third dimension (350) is a measure of the closest approach of splash guard tip (530) to the outer surface of the developer roller (104). In one exemplary embodiment, the splash guard tip (530) is located approximately one millimeter from the surface of the squeegee roller (112) and two millimeters away from the developer roller (104).

Figure 6:
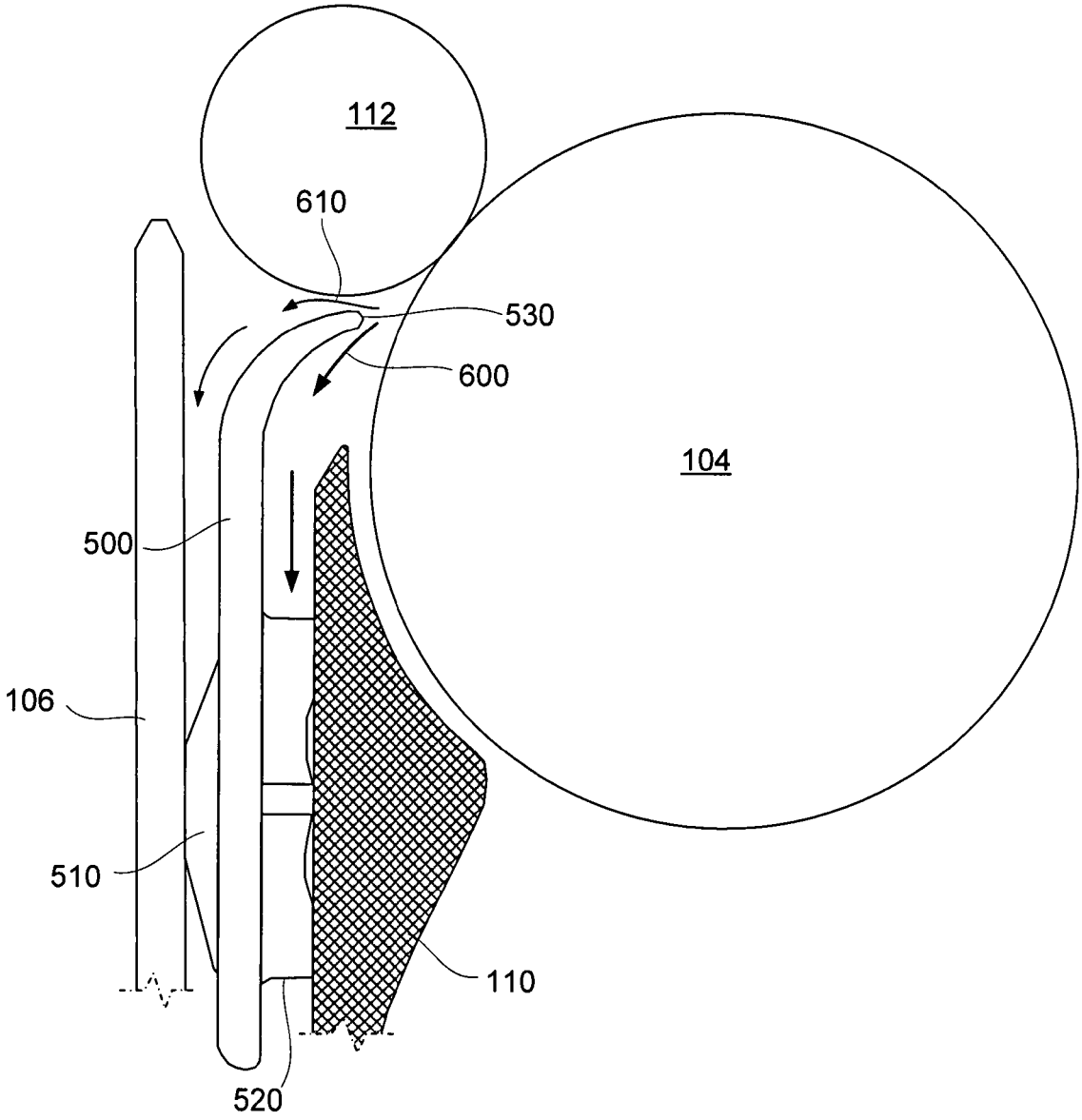
FIG. 6 is a cross-sectional diagram of an illustrative ink developer device, according to principles described herein.

FIG. 6 shows an exemplary flow of ink through the device illustrated in FIG. 5. The splash guard (500) is mounted to either the main electrode (110) or the ink tray (106). The splash guard (500) can be positioned with respect to the other components by inserting an alignment feature (540, FIG. 5) into a matching cavity in another component or by other means.

The splash guard (500) is configured to split the flow of excess ink knocked down by the squeegee roller (112) into two separate streams. The majority of the ink (600) knocked down by the squeegee roller (112) is deflected downward by the splash guard tip (530) and passes between the main electrode (110) and the front surface of splash guard (500). A lesser, but still significant portion of the ink (610) passes between the squeegee roller (112) and the splash guard tip (530).

This second flow of ink (610) is sufficient to maintain a steady stream of ink down the back of the splash guard (500) and toward the ink outlet (108, FIG. 2). Because the second flow of ink is constantly moving toward the ink outlet (108, FIG. 2), no portion of the flow is exposed to the atmosphere long enough for a significant percentage of the carrier fluid to evaporate. Further, the steady stream of ink (610) washes stray ink particles toward the ink outlet (108, FIG. 2). This significantly reduces the build up of sludge in the ink developer device, reducing the required maintenance of the machine and prolonging the life of its components.

The splash guard (500) contains squeegee splashes by precisely positioning the splash guard tip (530) such that the area between the splash guard tip (530) and the squeegee roller (112) is substantially filled by the second flow of ink (610). This "fluid seal" between the splash guard tip (530) and the squeegee roller (112) prevents any splashes generated by the squeegee roller (112) from escaping the ink developer device.

Figure 7:
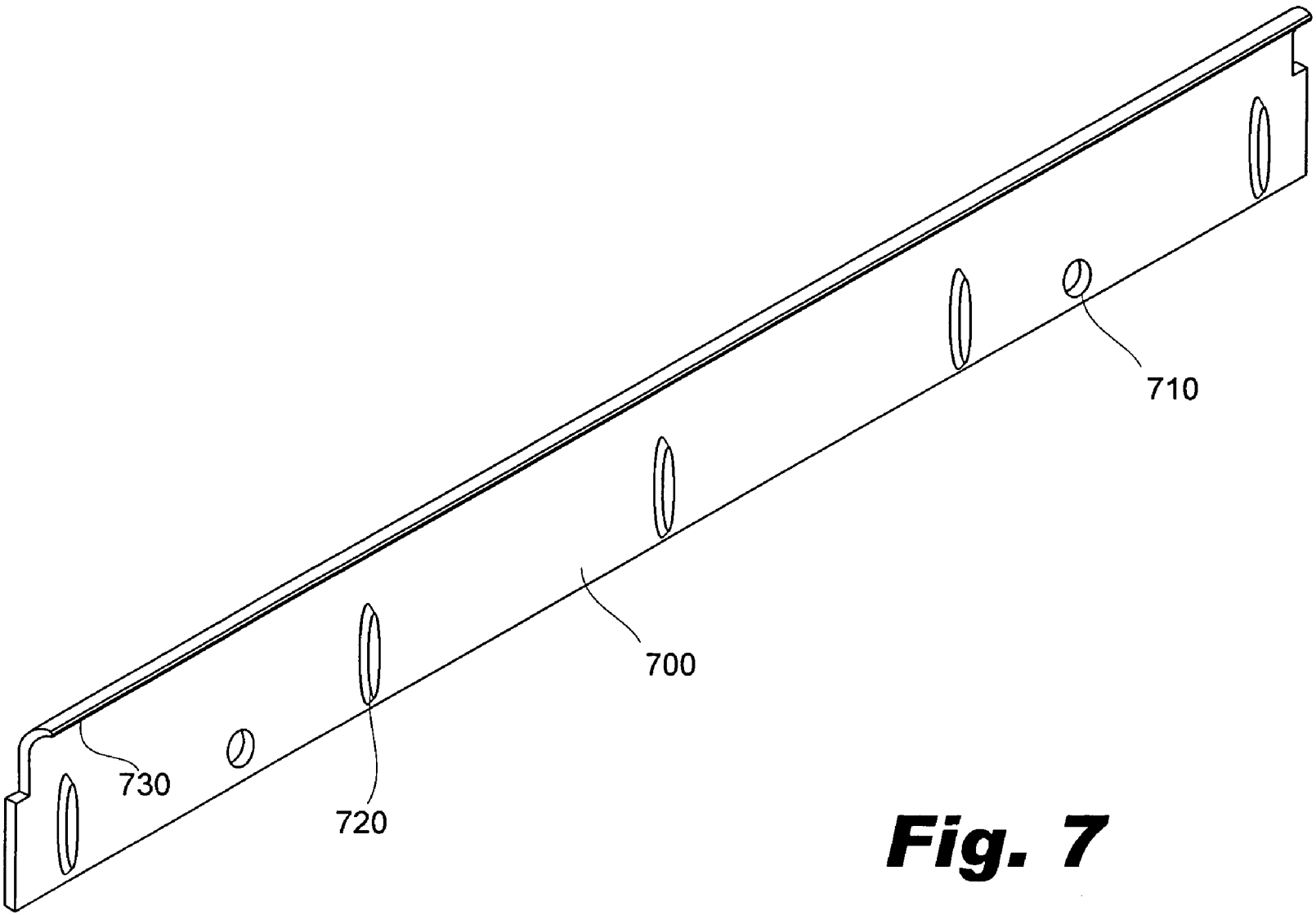
FIG. 7 is a perspective view of an illustrative splash guard, according to principles described herein.

FIG. 7 shows a perspective view of one exemplary embodiment of a splash guard (700). The body of the splash guard (700) is substantially rectangular, with the top edge curving inward to form a splash guard tip (730).

Spacers (720) are shown at even intervals along the side of the splash guard (700) and are designed to maintain the desired distance between the guard and the main electrode (110, FIG. 6). In this embodiment, the spacers (720) do not contain an alignment feature (540, FIG. 5). Instead, a plurality of orifices (710) in the body of the splash guard (700) is configured to receive fasteners, such as screws, that will hold the splash guard in place. A variety of methods could be used to precisely position the splash guard (700) with respect to the other components prior fixing the splash guard (700) in position using the fasteners.

By way of example and not limitation, an alignment fixture could be inserted between the splash guard (500) and the rollers (104, 112) to precisely define the position of the splash guard tip (730). The fasteners could then be tightened to fix the splash guard (700) in position. Following the tightening of the fasteners, the fixture is removed.

As described herein, the splash guard (700) reduces squeegee splashes, which, in turn reduces the risk of print quality defects, cross contamination, and messy leaks that that can cause customers to prematurely replace the ink developer device. Rather than trying to eliminate the flow over the back side of the splash guard, the invention controls the flow so that there is a constant stream of ink that does not have time to solidify and clog the gap between the splash guard and the tray wall. When small amounts of sludge do build up, there is enough flow to break up the sludge and transport it back to the ink tank.

The splash guard is a low cost solution that can be implemented in a single part. Consequently, the splash guard disclosed herein can be retrofit to existing printing systems and developer devices, with no substantial modification of existing components.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. An apparatus for containing squeegee splashes in an ink developer device comprising:

a developer roller, said developer roller configured to provide a film of ink adhering to an outer surface of said developer roller;

a squeegee roller, said squeegee roller configured to compact said film of ink and remove excess ink from said developer roller;

a splash guard with a tip interposed between said squeegee roller and said developer roller;

wherein said splash guard is configured to split a flow of said excess ink produced by said squeegee roller.

2. The apparatus of claim 1, wherein said splash guard further comprises a plurality of spacers configured to create channels for ink flow.

3. The apparatus of claim 1, wherein said splash guard further comprises a front face and a back face, wherein a portion of said excess ink travels down said front face and a portion of said excess ink travels down said back face.

4. The apparatus of claim 1, wherein splash guard tip approaches an interface between said squeegee roller and said developer roller at approximately a 45 degree angle.

5. The apparatus of claim 4, wherein the location of said splash guard is further defined by a first dimension, said first dimension defining the distance between said splash guard tip and said squeegee roller.

6. The apparatus of claim 5, wherein the location of said splash guard is further defined by a second dimension, said second dimension defining the distance between said splash guard tip and said developer roller.

7. The apparatus of claim 6, wherein said first dimension is approximately half of said second dimension.

8. The apparatus of claim 6, wherein said first dimension approximately one millimeter and said second dimension approximately two millimeters.

9. The apparatus of claim 1, wherein said splash guard further comprises an integral alignment feature.

10. The apparatus of claim 9, wherein said splash guard further comprises a plurality of orifices configured to receive a plurality of fasteners.

11. The apparatus of claim 1, wherein said excess ink flow is recirculated.

12. The apparatus of claim 1, wherein said apparatus is integrated in a binary ink developer.

13. The apparatus of claim 3, wherein said portion of excess ink traveling down said back face washes accumulated ink particles from said back face of said splash guard.

14. An apparatus for containing squeegee splashes in an ink developer device comprising:

a developer roller, said developer roller configured to provide a film of ink adhering to an outer surface of said developer roller;

a squeegee roller, said squeegee roller configured to compact said film of ink and remove excess ink from said developer roller;

a splash guard comprising means for splitting a flow of excess ink removed from said developer roller by said squeegee roller such that a portion of said flow of excess ink flows by a front surface of said splash guard and a second portion of said flow of excess ink flows over a back surface of said splash guard and washes accumulated ink particles from said back surface.

15. The apparatus of claim 14, wherein said means for splitting a flow of excess ink comprise an angled tip of said splash guard angled toward an interface between said squeegee roller and said developer roller.

* * * * *